US006132143A

United States Patent [19]

Hovinga et al.

[11] Patent Number: 6,132,143

[45] **Date of Patent: *Oct. 17, 2000**

[54] METHOD FOR LIFTING A SEA PLATFORM FROM THE SUBSTRUCTURE

[75] Inventors: Robert Paul Hovinga, Naaldwijk; Klaas Boudewijn van Gelder, Delft; Arnold Andries van den Dool, Rotterdam; Peter Ronald De Jong, Leiden, all of Netherlands

[73] Assignee: Allseas Group S.A., Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/842,243

[22] Filed: Apr. 23, 1997

[30] Foreign Application Priority Data

Apr. 24, 1996 [NL] Netherlands ..... 1002938

[51] Int. Cl.[7] ..... E02D 23/02; E02D 25/00

[52] U.S. Cl. ..... 405/206; 405/205; 405/209

[58] Field of Search ..... 405/205, 206, 405/209, 204, 195.1

[56] References Cited

U.S. PATENT DOCUMENTS

| | | | |
|---|---|---|---|
| 2,552,899 | 5/1951 | Manes | 405/206 |
| 2,581,098 | 1/1952 | Guenzel | 405/206 X |
| 2,938,354 | 5/1960 | Knapp | 405/206 |
| 3,064,437 | 11/1962 | Knapp | 405/206 |
| 3,064,438 | 5/1962 | Sims | 405/206 X |
| 3,347,052 | 10/1967 | Steitle et al. | 405/205 |
| 3,633,369 | 1/1972 | Lawrence | 405/205 |
| 4,973,200 | 11/1990 | Kaldenbach | 405/206 X |

FOREIGN PATENT DOCUMENTS

| | | | |
|---|---|---|---|
| 2476715 | 8/1981 | France | 405/206 |
| 2571075 | 4/1986 | France | 405/206 |
| 1015040 | 4/1983 | U.S.S.R. | 405/206 |
| 1158672 | 5/1985 | U.S.S.R. | 405/206 |
| 2002048 | 2/1978 | United Kingdom | 405/206 |

*Primary Examiner*—Dennis L. Taylor
*Attorney, Agent, or Firm*—Mark Zovko

[57] ABSTRACT

A method for lifting a sea platform with its substructure attached from a seabed and moving that platform to a different location. Use is made of flotation bodies which are filled with water and attached to the substructure. The flotation bodies can be emptied of some water to provide greater flotation and can be rotated around a horizontal axis to facilitate movement of the entire assembly under various sea conditions.

4 Claims, 6 Drawing Sheets

METHOD FOR LIFTING A SEA PLATFORM FROM THE SUBSTRUCTURE

The invention relates to a method for lifting a sea platform or like construction from the substructure, wherein use is made of at least one flotation body.

In the exploitation of oil wells in relatively shallow areas of water, for instance the continental shelf of Europe, it is usual to place sea platforms or the like and anchor them on the seabed using a jacket. Such constructions have to be removed again after a period of time and the methods existing heretofore are rather time-consuming and costly.

The invention has for its object to provide a method with which lifting of the sea platform can be performed in relatively simple manner and wherein the sea platform can be taken to a location where total dismantling is easier to carry out.

The method according to the invention is distinguished in that

- the flotation body is fixed to a part of the substructure,
- the flotation body is given a buoyancy by removing part of the water from the flotation body,
- a separation is made in the substructure below the connection point between flotation body and substructure,
- the buoyancy of the flotation body is increased by removing more water, and
- the or each flotation body with platform part fixed thereto is moved to an end location.

Due to the use of a flotation body which is fixed to the substructure, i.e. the jacket, it is possible after increasing the buoyancy therof and after separating the substructure below the connecting point of the or each flotation body to raise and remove the whole construction including the substructure or a portion thereof.

By first submerging the or each flotation body below the water surface prior to fixing to the substructure, for instance by filling this body at least partially with water, disrupting influences resulting from swell (waves and current) can be largely avoided whereby the fixing entails less risk of damage.

According to a particularly effective method the invention proposes to rotate each flotation body through a predetermined angle round a lying pivot axis after fixing to the substructure in order to be able to transect the water level and thus obtain the desired stability. During fixing of the flotation body to the substructure this body herein remains far below sea level and is thereby virtually unaffected by the swell.

Another method makes use of flotation bodies of changeable volume in order here also to create a surface which transects a water level and to obtain the desired stability.

The invention further relates to a flotation body for use in a method as described above, wherein the flotation body is formed from an elongate box-like body which is provided on at least one side with at least two fixing means suitable for fixing to the vertical posts of the substructure or jacket.

The fixing means are preferably formed according to the invention by a clamp. This clamp can consist of two shell-like parts which can be closed round the substructure post.

According to the invention a hinge is arranged between the clamp and the flotation body in order to enable the rotation of the flotation body relative to the substructure. The flotation body can also be provided according to the invention with a spacer between the fixing means and the flotation body to get the flotation body partially above sea level after the rotation. The loads on the jacket are smaller with this construction.

Above mentioned and other features will be further elucidated hereinbelow in the figure description of a number of embodiments.

In the drawing:

FIG. 1 shows a perspective top view of a drilling platform, on the substructure of which two flotation bodies are fixed, FIGS. 2, 3, 4, 5 show in each case standing views of the drilling platform of FIG. 1 differently embodied flotation bodies which are fixable to the jacket and displaceable relative thereto, FIG. 6 is a perspective view of a construction with jacket substructure provided with flotation bodies of changeable volume, FIG. 7 shows a standing view corresponding with FIG. 2 of flotation bodies fixed to the jacket, wherein use is made of tidal movement, FIG. 8 shows a detail in perspective of the fixing means in the form of a clamp between the flotation body and an upright post of the substructure.

Figure 1:
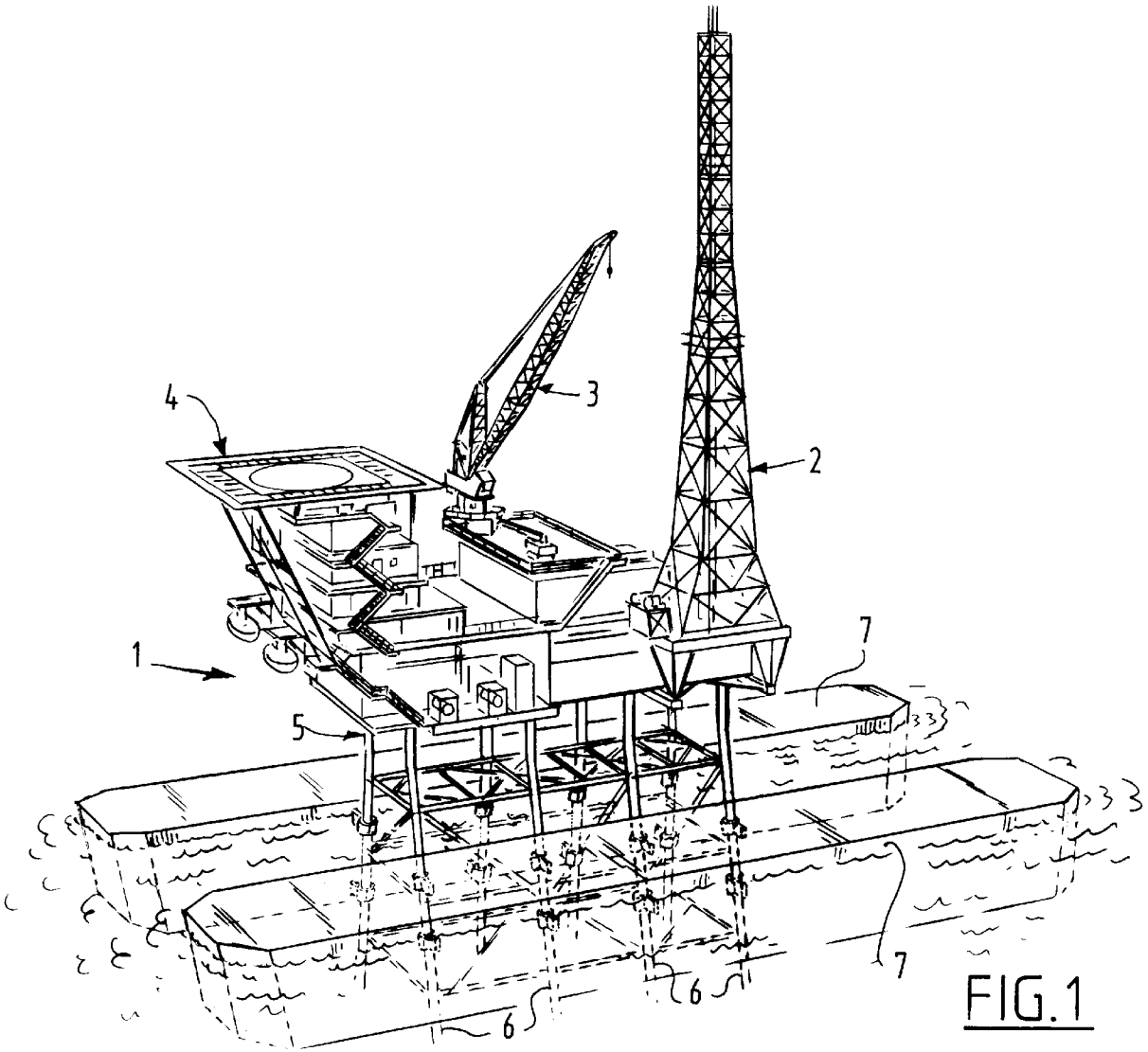

Designated in FIG. 1 with the numeral 1 is a work platform which can have a random function and be of random structure. Shown in the drawing is a drilling rig (2), a hoisting frame (3), a landing platform (4) and further work areas an accommodation areas for personnel. The platform is arranged on a substructure or jacket (5) which consists here of a plurality of vertically directed posts (6) which are mutually connected by cross struts to form a diagonal bracing.

The posts stand on the seabed (not shown).

It is the objective according to the invention to release the substructure (6) from the seabed and lift it with flotation bodies (7) such that the whole construction can be taken to a location for further dismantling.

Figure 2:
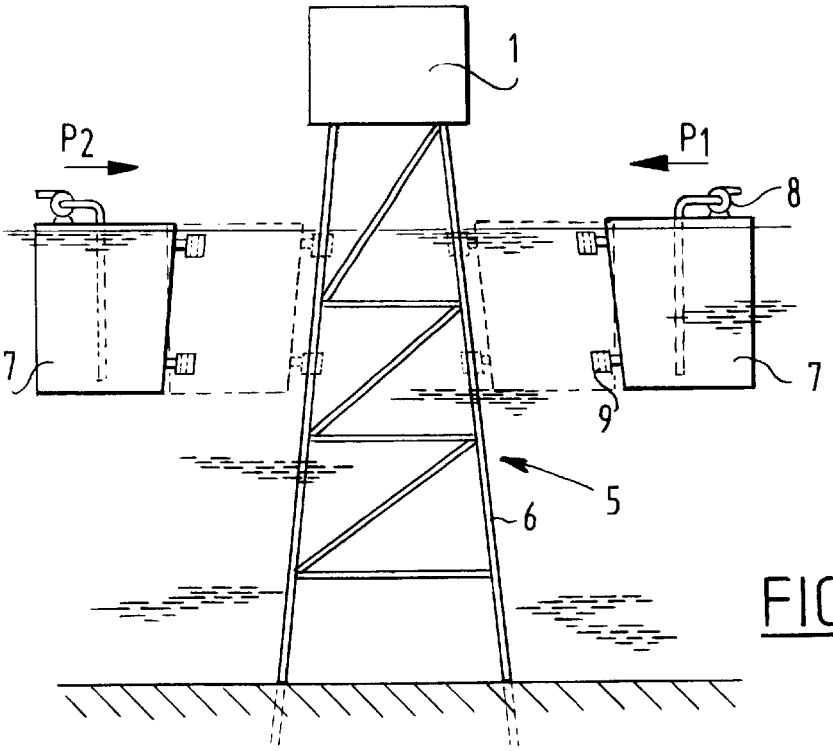

The flotation bodies according to the invention can be of random type, for instance in the form of lighters or in the form of closed pontoons embodied in box shape, see FIGS. 2 and following. Each flotation body is fillable with water and can be emptied by means of for instance a pump (8) as shown in FIG. 2, the suction line of which debouches in the space of the flotation body (7). The flotation body can be provided with tanks (not shown) placed above sea level which can be emptied quickly, whereby the buoyant effect can be increased rapidly.

The side of flotation body (7) facing toward jacket (5) is provided with fixing means (9) which are further elucidated hereinbelow.

It is the intention to fill tanks in flotation body (7) with water such that a comparatively small submerged weight is obtained (for instance between 100 and 1,000 tons) wherein it comes to lie practically underwater, see FIG. 2, whereafter the flotation body can be carried using a crane or derrick in the direction of arrow P1 towards the side of jacket (5) and the fixing means (9) can be fastened round the posts (6). The water is removed from flotation body (7) by means of pump (8) so that after cutting through the posts (6) at the position of level A the whole jacket with platform 1 standing thereon can be moved upward, wherein stability is achieved by the flotation bodies (7) which protrude some height above sea level Z. This whole construction can then be removed by means of tugboats.

Figure 3:
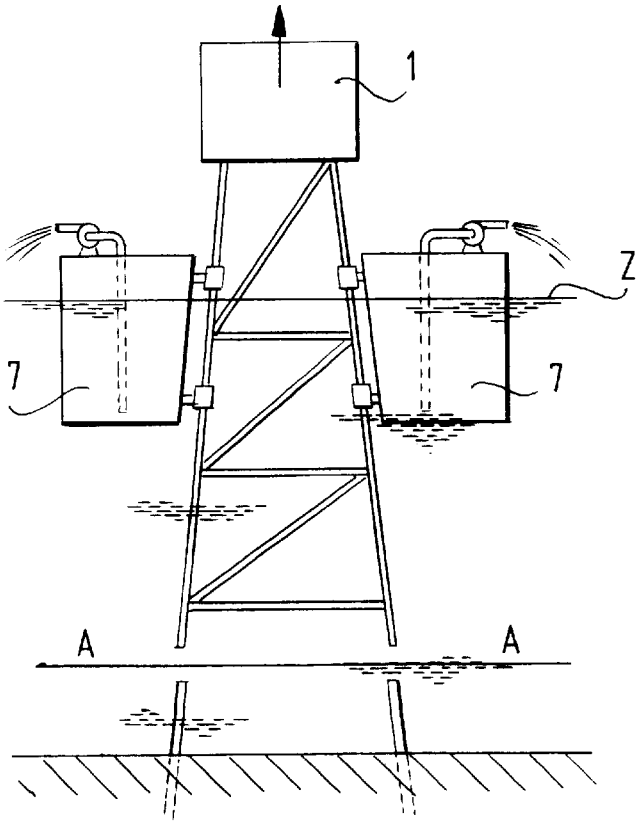
Figure 4:
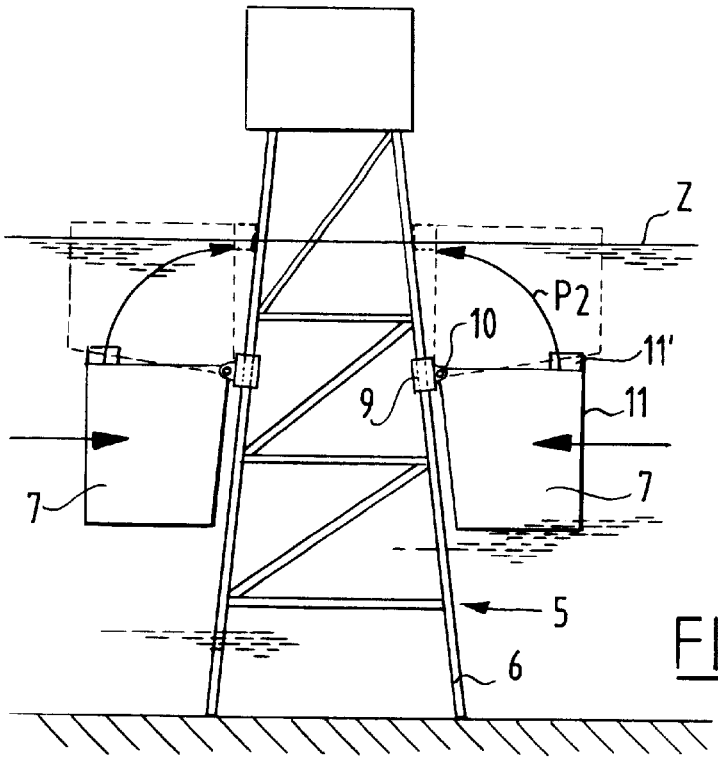

The construction of FIGS. 2 and 3 in respect of the flotation bodies is suitable for small swell. However, should it be expected that the sea swell will be rougher, then it is recommended to fix the flotation bodies (7) to jacket (5) at a lower level. This is shown in FIG. 4. Flotation bodies (7)

are submerged to a distance below the level Z, whereafter the fixing means (9) can be connected to posts (6) at a lower level. Because fixing means (9) are connected to flotation body (7) by means of the horizontal pivot axis, the flotation body (7) can be swung upward in the direction of arrow P2 after fastening of the means (9) to posts (6), whereby the outer side wall (11) comes to lie above the level Z. By admitting air into a relatively small compartment of the flotation body the water can be urged out of the flotation body (7) and the desired rotation as according to FIG. 3 can be effected. A buffer 11' bounds the upward rotation in that it strikes against the side of the substructure. It is known that wave effects are damped at greater depth, as are surface currents resulting from wind. Due to the low coupling of flotation bodies (7) to jacket (5), wave forces of 1st and 2nd order, i.e. high respectively low frequency, will hardly affect the flotation bodies (7) even in rough weather or high swell, whereby the fixing takes place more easily.

Although when the flotation bodies rise upward the above mentioned forces will once again affect the bodies, they are now secured to the jacket and the bodies can be controlled more easily with ballasts or buffers and traction wires.

Figure 5:
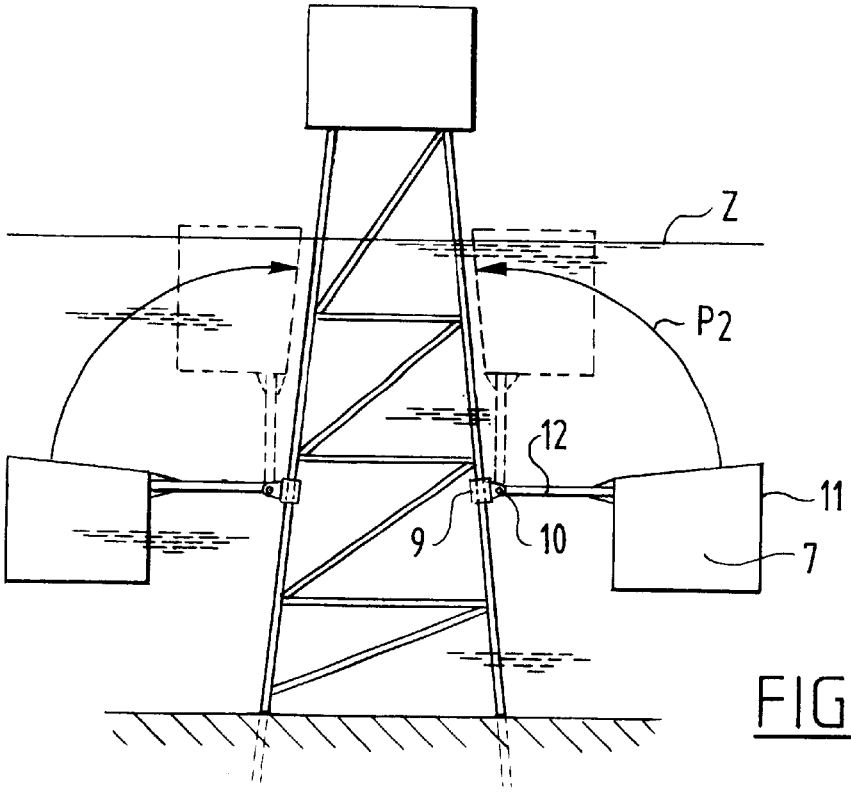

FIG. 5 shows an alternative embodiment of a fully submersible flotation body (7), since this is provided with a spacer (12) between the hinge (10) with horizontal pivot axis and the flotation body (7). In this manner the fixing means (9) can be arranged at an even lower level since after swinging as according to arrow P2 the pontoon can still be carried with side wall (11) above the level Z.

Figure 6:
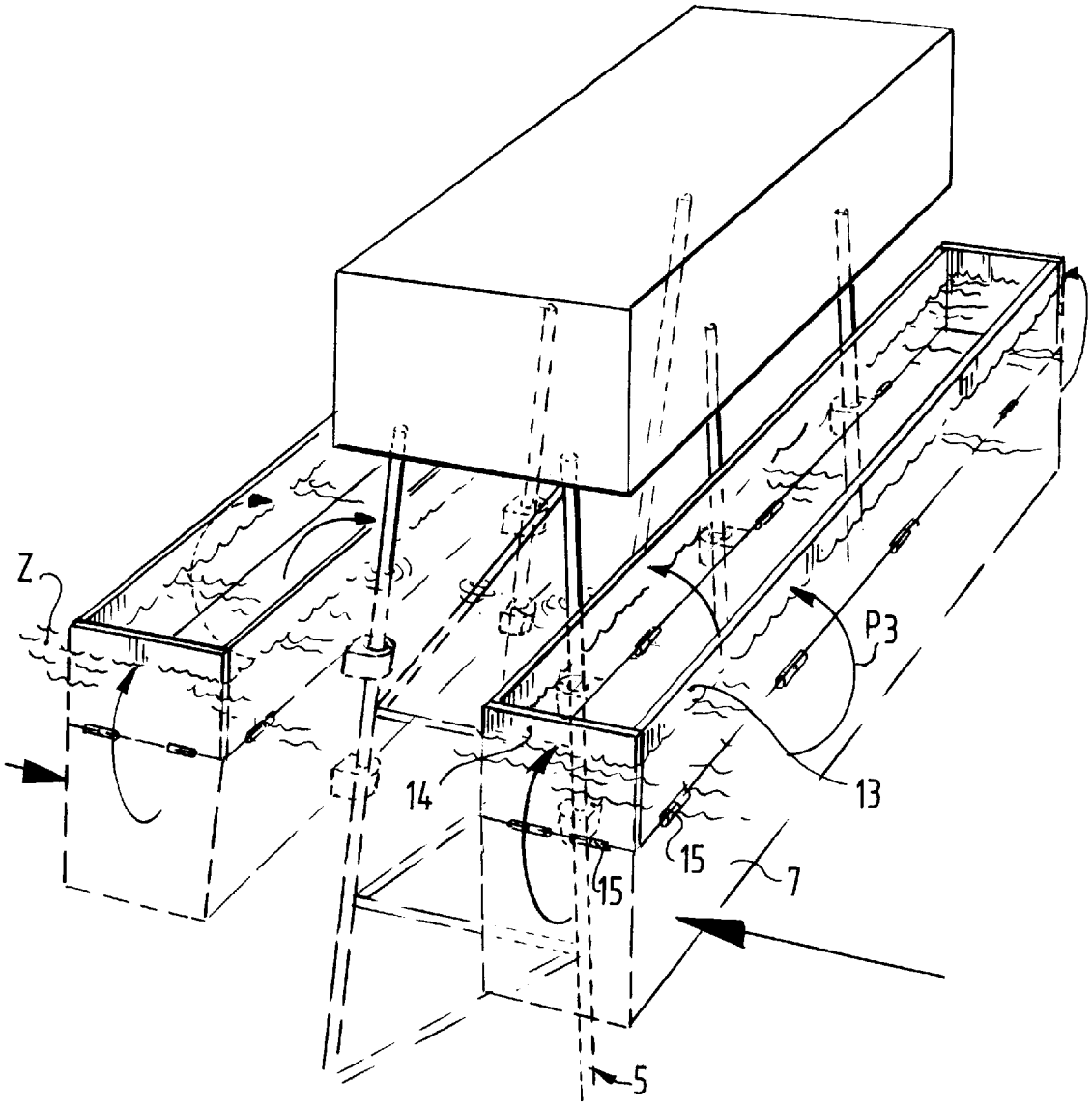

FIG. 6 shows an embodiment wherein each flotation body (7) is provide along the upper wall with folding or upwardly slidable flaps (13,14) which can be swung upward in the direction of arrow P3 on the hinges (15). While it is thus possible to couple the flotation bodies (7) to jacket (5) below the level Z, it is also possible, by then moving the flaps (13,14) upward, to create a water-transecting surface in the level Z. The buoyant effect of flotation bodies (7) is brought about by pumping empty the volume in the flotation body and that between the flaps, so that the platform can be raised in stable situation.

Figure 7:
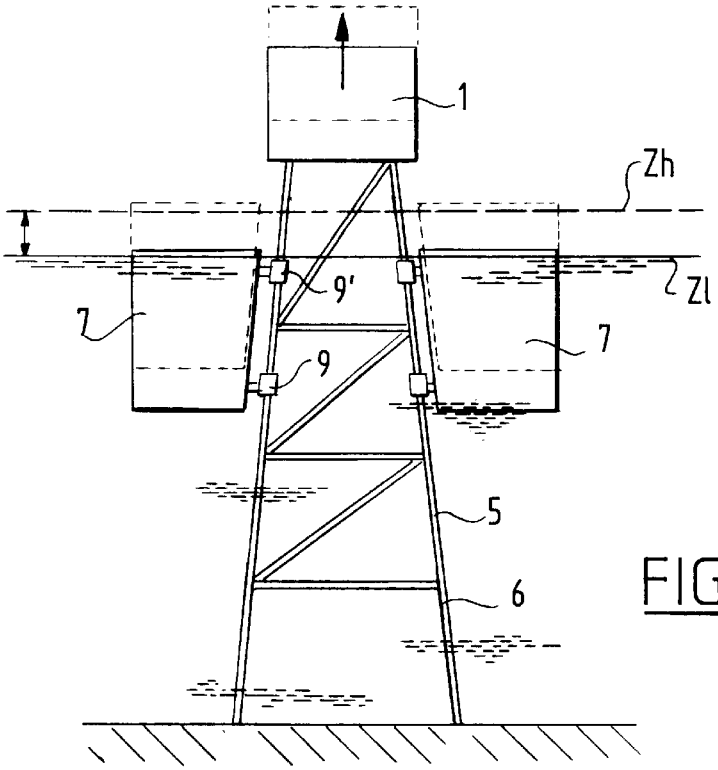

FIG. 7 shows an option for the submersible flotation bodies (7) which are embodied with fixing means (9,9') such that with use of tidal movements the flotation bodies (7) can be fixed to jacket (5) at a high sea level Zh such that at low tide Zl the flotation bodies (7) come to protrude above the level Z. After separating the posts (6) of the jacket the flotation body (7) moves automatically upward, carrying with it the platform (1).

Hereinbelow follows a discussion of the fixing means shown in FIGS. 8, 9, 10 and 11.

Figure 8:
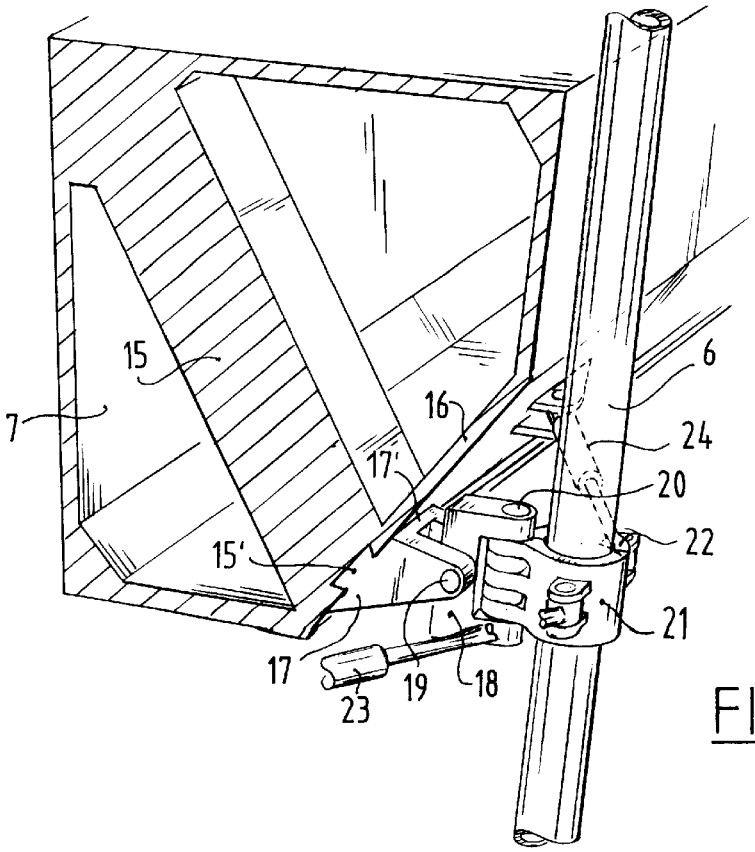

FIG. 8 shows a cross section of the flotation body (7) which is here a closed box-like body reinforced by cross struts (15). Mounted on the slanting wall (16) are two ears (17) between which a U-shaped holder (18) is arranged pivotally round the pin (19). Pin (19) is mounted in an eye of the ear (17).

Arranged in the U-shaped holder (18) is a vertical pin (20) around which two shells (21,22) are pivotable. Each shell is coupled to a cylinder (23,24) which supports on the side wall (16) of flotation body (7). Each shell (21,22) can be moved away from respectively toward the other by means of cylinder (23,24). The shell is formed such that it can be arranged clampingly round a post (6) of the jacket. With the pivot pin (19) the flotation body (7) can be carried from the lower to the upward folded position as shown in FIG. 4.

The ears (17) can also be arranged on a body portion 17', which body portion is displaceable along the sloping wall via a longitudinal guide (15') therein to enable varying of the distance between the clamps and adapt it to the distance between the posts of the substructure.

FIG. 9 once again shows a fixing means (9) which consists here of two shells (21,22) which are rotatable round a pin (20) relative to each other. In the closed position the shells form a sleeve with a conically tapering inner wall. Wedges (13) are arranged round the post (6) of the jacket such that when the closed shells are moved upward as according to arrow P4 the funnel-shaped inner wall thereof presses against the outside of wedges (31) to clamp fixedly thereon. In the case of an upward force on sleeve (21,22) this force will be transmitted to post (6) and carry it along in upward direction. It will be apparent that shell (21) is connected to the flotation body via a random connection (32). This may for instance be the spacer (12) as according to FIG. 5.

Figure 9:
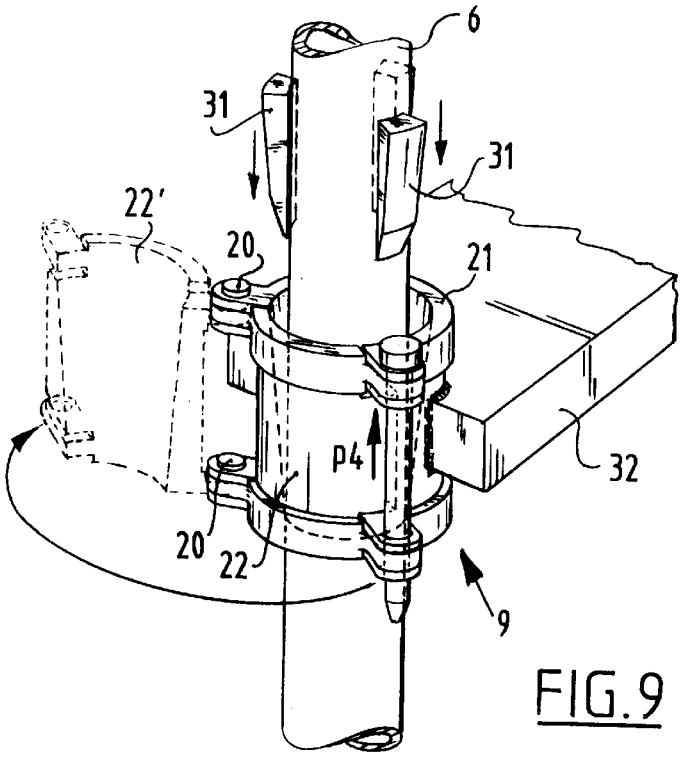
FIG. 9 shows a variant of the fixing means.
Figure 10:
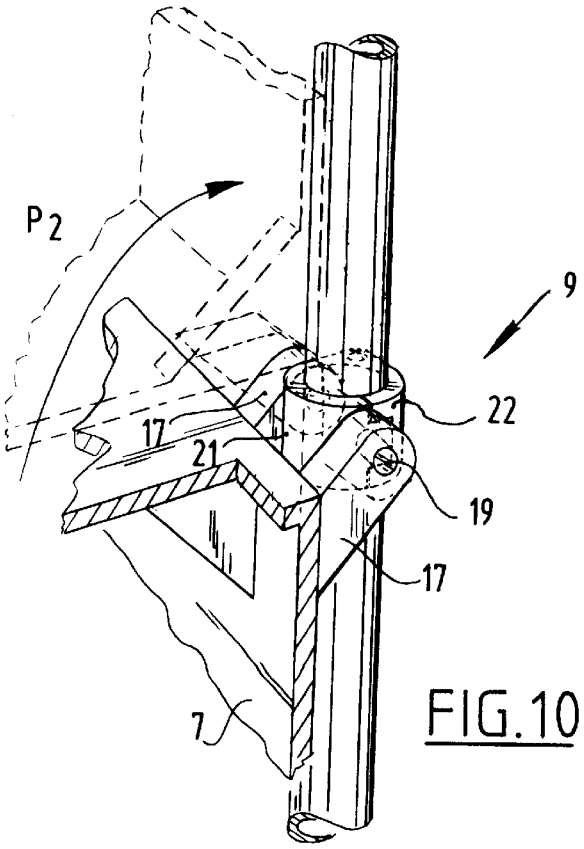
FIG. 10 shows a third variant of the fixing means.

FIG. 10 shows an embodiment of a connecting means (9) which is a combination of the embodiment of FIG. 8 and that of FIG. 9. The outer shell (22) can be clamped to the inner shell (21) by means of any suitable pressing member. The inner shell is provided with a pivot pin corresponding with pin (19) in FIG. 8 which is mounted rotatably in ears (17) fixed to the upper part of flotation body (7), this as according to the embodiment of FIG. 4. With this pivot pin (19) the flotation body can be swung upward in the direction of arrow P2.

Compared with the embodiment in FIG. 8 this embodiment has a more favourable load on the post of the substructure. The line of force here runs through the centre of the post whereby it does not come under strain of bending.

The invention is not limited to the above described embodiments. It is noted that the invention not only serves to remove the sub- and superstructure in one operation but that it can also be performed in parts. This may be particularly important in the case of deep-water jackets, of which the superstructure with a part of the jacket is first removed and then the remaining part or parts of the jacket, for which purpose the flotation body must in any case be fully submersible.

It is finally noted that the clamps as described can be replaced by fixing means formed in other manner. Here can be envisaged for instance:

a hook, a hoisting sling, a hook or eye fixed to an intersection point of the jacket by a "plastic matrix" cast round the intersection, a support point pressing under the deck of the superstructure.

What is claimed is:

1. Method for lifting a sea platform with a substructure attached thereto, using at least one flotation body, the substructure standing on a seabed which includes:

a) submerging said flotation body under sea level by at least partially filling said flotation body with water;

b) fixing said flotation body to the substructure at a level below any sea swell thereby avoiding damage to said substructure by collision with said flotation body due to sea swell:

c) separating the substructure from the seabed below the connection point between said flotation body and the substructure;

d) removing at least part of the water from said flotation body until said flotation body has traversed the sea level; and e) moving said flotation body with at least part of the substructure and sea platform fixed thereto to a different location while maintaining said sea platform in an upright position.

2. The method of claim 1 wherein said flotation body is at least partially filled with water and submerged below the water surface prior to fixing said flotation body to a part of the substructure.

3. The method of claim 1 which includes rotating said flotation body through a predetermined angle around a horizontal pivot axis after fixing said flotation body to the substructure at a level below any sea swell thereby stabilizing the assembly of said flotation body and the substructure.

4. The method of claim 1 which includes changing the volume of said flotation body after said flotation body is fixed to the substructure by expanding the size of said flotation body.

* * * * *